US005577379A

United States Patent [19]

Johnson

[11] Patent Number: 5,577,379

[45] Date of Patent: Nov. 26, 1996

[54] FUEL NOZZLE GUIDE RETAINER ASSEMBLY

[75] Inventor: Thomas E. Johnson, Manchester, Conn.

[73] Assignee: United Technologies Corporation, Hartford, Conn.

[21] Appl. No.: 356,093

[22] Filed: Dec. 15, 1994

[51] Int. Cl.[6] ..... F02C 7/20

[52] U.S. Cl. ..... 60/39.31; 60/756; 60/740

[58] Field of Search ..... 60/39.31, 39.32, 60/39.36, 752, 756, 757, 740

[56] References Cited

U.S. PATENT DOCUMENTS

| | | | |
|---|---|---|---|
| 3,007,312 | 11/1961 | Shutts | 60/39.32 |
| 3,485,043 | 12/1969 | Ehrich | 60/757 |
| 4,914,918 | 4/1990 | Sullivan | 60/39.32 |
| 5,129,231 | 7/1992 | Becker et al. | 60/756 |
| 5,172,545 | 12/1992 | Forestier | 60/39.32 |
| 5,222,358 | 6/1993 | Chaput et al. | 60/39.32 |
| 5,461,866 | 10/1995 | Sullivan et al. | 60/757 |

*Primary Examiner*—Timothy Thorpe
*Assistant Examiner*—Ted Kim
*Attorney, Agent, or Firm*—Edward L. Kochey, Jr.

[57] ABSTRACT

Fuel nozzle guide 24 is threaded to fuel nozzle guide retainer 26, entrapping bulkhead 14, bulkhead liner 30 and key washer 28. Internal tabs 74 lock within slot 76 in the threads of the fuel nozzle guide. External tabs 78 of the key washer are bent into slot 80 of the retainer 26, after the nozzle guide 24 and the retainer are threaded together.

4 Claims, 2 Drawing Sheets

FUEL NOZZLE GUIDE RETAINER ASSEMBLY

TECHNICAL FIELD

The invention relates to gas turbine engine combustors and in particular to an assembly for retaining the fuel nozzle guides.

BACKGROUND OF THE INVENTION

Nozzle guides are used in the bulkhead which defines the upstream end of the combustor of a gas turbine engine. This provides a sliding fit between the fuel nozzle and the combustor bulkhead to properly guide the nozzle during differential movement.

Nozzle guides and nozzle guide retainers are used to seal the gap between the nozzle and the bulkhead or bulkhead liner. The nozzle guide and retainer are typically screwed together and then locked together by applying a weld bead to the threaded joint or a castellated ring. The welding needed to lock the guide and retainer together can be a problem in the tight working conditions. Welding is also expensive. The parts after being welded are difficult to take apart, which is frequently needed and this often results in the destruction in the guide retainer. These are expensive parts.

Copending application 08/356,088 shows a bulkhead with a raised lip adjacent a nozzle opening.

SUMMARY OF THE INVENTION

A fuel nozzle guide retainer assembly for a gas turbine engine includes a bulkhead defining the upstream end of the combustor. There is an opening in the bulkhead for the insertion of the fuel nozzle with the fuel nozzle guide extending through this opening. It extends through the opening from the combustor side and has external threads on the portion passing through the opening. It has an outside diameter flange on the combustor side which limits movement through the opening.

A nozzle guide retainer has internal threads which mate with the fuel nozzle guide external threads. It cooperates with the nozzle guide retainer to hold it firmly within the bulkhead, locking therebetween the bulkhead thead the bulkhead liner and the key washer.

This key washer is located between the nozzle guide retainer and the nozzle guide and it has external tabs and internal tabs for locking the two members together. The internal tabs fit within slots in the nozzle guide while the external tabs fit within slots in the nozzle guide retainer. These external tabs are placed within the slots after tightening the nozzle guide retainer on the fuel nozzle guide and prevent the two parts from rotating relative to one another.

DESCRIPTION OF THE PREFERRED EMBODIMENT

Figure 1:
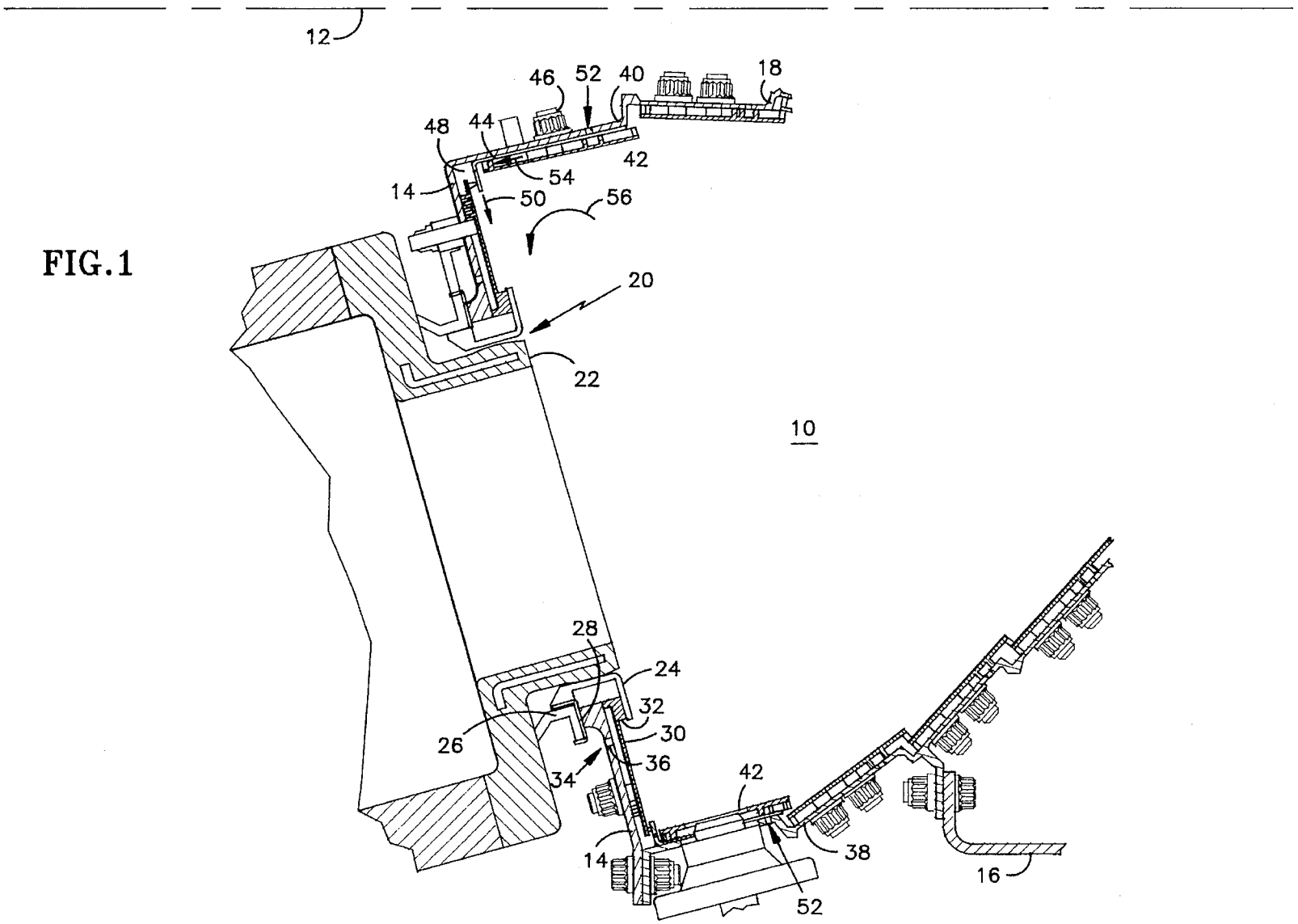
FIG. 1 is a sectional view through the upstream end of the annular combustor.

FIG. 1 shows an annular gas turbine combustor 10 and the centerline 12 of the gas turbine engine. The conical bulkhead 14 is supported from support structures 16 and 18. Sixteen gas turbine nozzle openings 20 are located around the circumference of the bulkhead.

A plurality of fuel nozzles 22 are locatable within these openings. These nozzles are preferably of the low $NO_x$ type with premixing of fuel and air for low temperature combustion. At each opening there is a fuel nozzle guide 24 which is axially restrained with fuel nozzle guide retainer 26. The key washer 28 prevents rotation of the fuel nozzle guide retainer 26 after installation.

The fuel nozzle guide 24 and the retainer 26 are secured to contain between them the key washer 28, the bulkhead 14 and the bulkhead liner 30. Good contact at 32 is maintained between the guide and the liner segments to avoid any significant amount of air passing therethrough. Similarly good contact is maintained on both sides of the key washer 28 to prevent significant air flow past the washer.

The cooling air flow 34 passes through a plurality of openings 36 in the bulkhead impinging against the bulkhead liner 30, with the air passing behind the liner in a direction away from the location of fuel nozzle 22.

An outer shell 38 and an inner shell 40 define the boundaries of the combustor and have bolted thereto a plurality of float wall liner panels 42 at the upstream end of the combustor. A fairing 44 is entrapped between the adjacent shell and the liner panel 42. A plurality of studs and bolts 46 removably secure this structure.

The cooling air flow passing toward the shells and between the bulkhead and the bulkhead liner flows toward the corner area 48 where it turns and is guided in direction 50 along the bulkhead liner.

Cooling flow 52 passing through the inner shell and the outer shell impinges against the liner 42 with the portion of this flow passing as flow 54 toward corner 48 where fairing 44 also deflects it toward the fuel nozzle. The recirculating type flow 56 desired within the combustor is not disturbed by the direction of flow 50 which cools the bulkhead liner.

Figure 2:
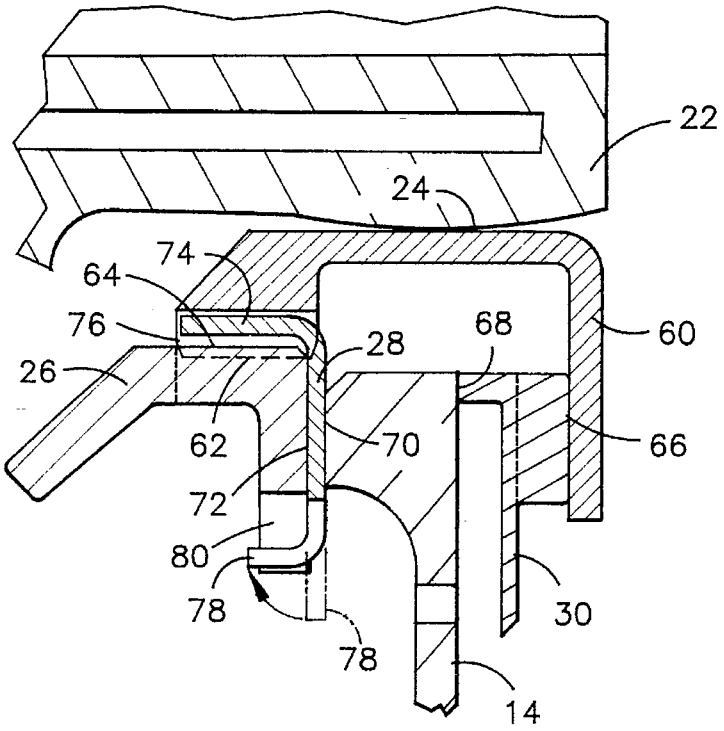
FIG. 2 is a detailed section of the fuel nozzle guide, the fuel nozzle guide retainer and the key washer.
Figure 3:
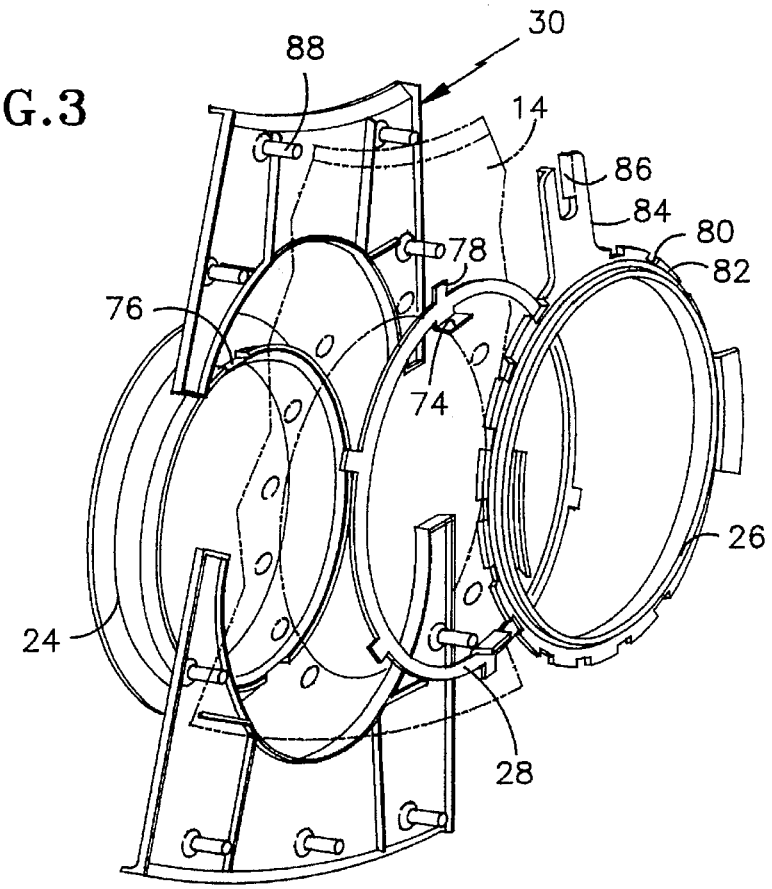
FIG. 3 is an exploded view of the retainer arrangement.

Referring to FIG. 2 which shows the nozzle guide retainer assembly in the installed position and FIG. 3 which is an exploded view of the assembly bulkhead 14 and the bulkhead liner 30 can be seen. Fuel nozzle guide 24 is shown with an outside diameter flange 60 on the combustor side of the bulkhead. Nozzle guide retainer 26 is held on the upstream side of the bulkhead while the nozzle guide retainer 24 is placed through the opening, and rotated with external thread 62 on the guide mated with internal threads 64 on the retainer.

This is rotated until a snug fit is achieved at interfaces 66, 68, 70 and 72. The nozzle guide is backed off slightly and locked into place. This locking is accomplished by key washer 28 which has internal tabs 74 bent and fitting within slots 76 is the fuel nozzle guide. External tabs 78 are bent to fit within slots 80 of the nozzle guide retainer after the tightening of the nozzle guide retainer onto the fuel nozzle. The slots 80 are formed at various locations by a plurality of castellations 82 located around the periphery of the fuel nozzle guide retainer. This permits locking the two components in any one of the plurality of circumferential relationships.

The bulkhead 14 and the bulkhead liner 30 are entrapped between the guide and retainer along with the key washer 28. Ear 84 on the retainer has a slot 86 which combines with post 88 on the liner to prevent rotation of the retainer.

Welding is not required to lock the fuel nozzle guide retainer and the fuel nozzle guide together and the only operation needed is to bend the key washer tabs. This can easily be done in a tight working condition. The expensive welding is avoided. The parts may easily be taken apart by straightening the key washer tabs and are normally expected to be reused. The major parts can certainly be reused, and while the key washer could be reused, it is so inexpensive that it is preferably replaced.

I claim:

1. The fuel nozzle guide retainer assembly for a gas turbine engine comprising:

a bulkhead defining the upstream end of a combustor;

at least one opening in said bulkhead for the insertion of a fuel nozzle;

a fuel nozzle guide, extending through said opening from the combustor side, and having external threads on the portion passing through said opening, and having an outside diameter flange on the combustor side for limiting axial movement through said opening;

a nozzle guide retainer having internal threads mated with said fuel nozzle guide external threads and cooperating with said nozzle guide retainer to hold said nozzle guide retainer firmly within said bulkhead;

a key washer for locking and located between said nozzle guide retainer and said fuel nozzle guide, said key washer having external tabs and internal tabs;

said internal tabs fitting within slots in said nozzle guide;

said external tabs fitting within slots in said nozzle guide retainer after tightening of said nozzle guide retainer on said fuel nozzle guide;

said fuel nozzle guide having axially extending slots through said external thread; and said internal tabs located within said axially extending slots.

2. A retainer assembly as in claim 1 further comprising:

said nozzle guide retainer ring having an outside diameter and having a plurality of castellations on the outside diameter; and said extending tabs bent and located between at least some of said castellations.

3. A retainer assembly as in claim 1, further comprising:

a bulkhead liner located on the combustor side of both said bulkhead and said key washer; and said nozzle guide and said nozzle guide retainer entrapping said bulkhead liner as well as said bulkhead and said key washer.

4. A retainer assembly as in claim 2, further comprising:

a bulkhead liner located on the combustor side of both said bulkhead and said key washer; and said nozzle guide and said nozzle guide retainer entrapping said bulkhead liner as well as said bulkhead and said key washer.

* * * * *